US007028858B2

(12) United States Patent
Auer et al.

(10) Patent No.: US 7,028,858 B2
(45) Date of Patent: Apr. 18, 2006

(54) QUICK-TWIST POP-OFF CLOSURE

(75) Inventors: Robert T. Auer, East Stroudsburg, PA (US); Jameson P. Stull, Far Hills, NJ (US); Gene Stull, Far Hills, NJ (US)

(73) Assignee: Stull Technologies,, Somerset, NJ (US)

( * ) Notice: Subject to any disclaimer, the term of this patent is extended or adjusted under 35 U.S.C. 154(b) by 0 days.

(21) Appl. No.: 10/309,638

(22) Filed: Dec. 4, 2002

(65) Prior Publication Data

US 2003/0155322 A1 Aug. 21, 2003

Related U.S. Application Data

(60) Provisional application No. 60/358,042, filed on Feb. 19, 2002.

(51) Int. Cl.
*B65D 41/17* (2006.01)

(52) U.S. Cl. ..... 215/318; 215/43; 215/321; 215/344; 215/354; 220/780; 220/301

(58) Field of Classification Search ..... 215/303, 215/320, 321, 318, 354, 43, 332, 344; 220/787, 220/798, 800, 801, 802, 783, 301, 780
See application file for complete search history.

(56) References Cited

U.S. PATENT DOCUMENTS

| | | | | | |
|---|---|---|---|---|---|
| 697,371 | A | * | 4/1902 | Sindorf | 215/332 |
| 1,615,157 | A | * | 1/1927 | Baum | 215/292 |
| 2,721,595 | A | * | 10/1955 | Nichols | 220/800 |
| 3,136,458 | A | * | 6/1964 | Ruetz | 222/498 |
| 3,252,446 | A | * | 5/1966 | Bateman | 401/202 |
| 3,372,834 | A | | 3/1968 | Ayotte et al. | |
| 3,430,798 | A | | 3/1969 | Goyet et al. | |
| 3,468,447 | A | * | 9/1969 | Smalley | 215/295 |
| 3,476,278 | A | * | 11/1969 | Lollmann | 215/296 |
| 3,896,959 | A | * | 7/1975 | Roy | 215/222 |
| 3,910,444 | A | | 10/1975 | Foster | |
| 3,955,696 | A | | 5/1976 | Finke | |
| 3,964,605 | A | * | 6/1976 | Vezirian | 206/349 |
| 3,982,651 | A | | 9/1976 | Braun et al. | |
| 4,171,057 | A | * | 10/1979 | Gach | 215/211 |
| 4,511,050 | A | * | 4/1985 | Nicol | 215/219 |
| 5,384,096 | A | * | 1/1995 | Burns | 422/102 |
| 5,458,854 | A | * | 10/1995 | Burns | 422/102 |
| 5,529,202 | A | * | 6/1996 | Shamis | 220/301 |
| 5,927,531 | A | * | 7/1999 | Kuzma et al. | 215/321 |
| 5,944,208 | A | * | 8/1999 | Gale | 215/296 |
| 6,068,421 | A | * | 5/2000 | Pierpont | 401/78 |
| 6,330,959 | B1 | | 12/2001 | Dark | |
| 6,394,295 | B1 | * | 5/2002 | Claude | 215/318 |
| 6,426,049 | B1 | * | 7/2002 | Rosen et al. | 422/102 |
| 2001/0030196 | A1 | * | 10/2001 | Stull et al. | 220/780 |

* cited by examiner

*Primary Examiner*—Nathan J. Newhouse
*Assistant Examiner*—James Smalley
(74) *Attorney, Agent, or Firm*—Drinker Biddle & Reath LLP

(57) ABSTRACT

A closure for a container for holding contents therein generally comprises a surface for gripping the closure in order to twist it in either direction to open it. The closure has downwardly projecting teeth on its underside; the container has upwardly projecting teeth, which mate with the downwardly projecting teeth of the closure. An outer ring on the closure circumscribes and holds in place the upper lip of the container in the closed position. Twisting of the closure in either direction causes the closure to be released from the container.

4 Claims, 4 Drawing Sheets

QUICK-TWIST POP-OFF CLOSURE

CROSS REFERENCE TO RELATED APPLICATIONS

This application is a non-provisional utility counterpart of U.S. Provisional Application No. 60/358,042 filed on Feb. 19, 2002 for a Quick-Twist Closure.

STATEMENT REGARDING FEDERALLY-SPONSORED RESEARCH OR DEVELOPMENT

N/A

REFERENCE TO SEQUENCE LISTING

None

BACKGROUND OF THE INVENTION (1) Field of Invention

The present invention is directed to closures and more particularly to a closure which may be twisted in either direction for removal from a container.

(2) Description of Related Art and Information Disclosed Under 37 CFR 1.97 and 37 CFR 1.98.

Closures for containers for preventing inadvertent spilling of the contents and to facilitate the pouring of the contents have, of course, existed since time immemorial. Many closures must either:

(a) be removed at least partially from the containers to facilitate access for pouring of the contents; or (b) remain completely secured to the container, but permit the "communication" of a channel from the outside to the inside of the container to help pour the container contents.

The former type of closures are typically either "popped off" by lifting a closure tab over a container lip or twisted off. The closures which are twisted off typically have a long "skirt" which circumscribes the outer periphery of the neck of the container and typically "ride up" the neck of the container along twist grooves until the closure is fully removed. Further, such closures can be twisted off only in one direction.

It is an object of the invention to provide a Quick-Twist Pop-Off Closure which is economical to manufacture, requires less material and does not have a long "skirt" which circumscribes and twists along the outer periphery of the neck of the contents holding container.

Another object of the invention to provide a Quick-Twist Pop-Off Closure which can be twisted off in either rotational direction.

SUMMARY OF THE INVENTION

These and other aspects of the invention, which shall become hereafter apparent, are achieved by a Quick-Twist Pop-Off Closure which comprises a one-piece injection molded closure designed to work with a specialized container neck. Inside the cap are serrated "teeth" which engage a set of teeth on the wall of the container neck. Located at the top of the container is an annular ring configuration (the upper lip of the container) which is engaged by a complementary annular ring under the "skirt" of the cap. The closure further contains a plug seal to retain it firmly against the container.

The closure may be removed by turning the cap to the left or right, facilitating the unsnapping thereof from the container. The turning action insures that the annular ring of the closure—specifically the part on the underside, unsnaps from the upper lip of the container before the teeth are totally disengaged.

The closure provides for lower manufacturing cost because of a simplified and faster assembly process. The assembly requires a straight downward force to engage the teeth and snap the closure over the container lip. The closure does not require threading or turning to secure it onto the container.

BRIEF DESCRIPTION OF THE DRAWINGS

The invention will be better understood by the Detailed Description of the Preferred Embodiment, with reference to the drawings, in which.

DETAILED DESCRIPTION OF THE PREFERRED EMBODIMENT

Figure 1:
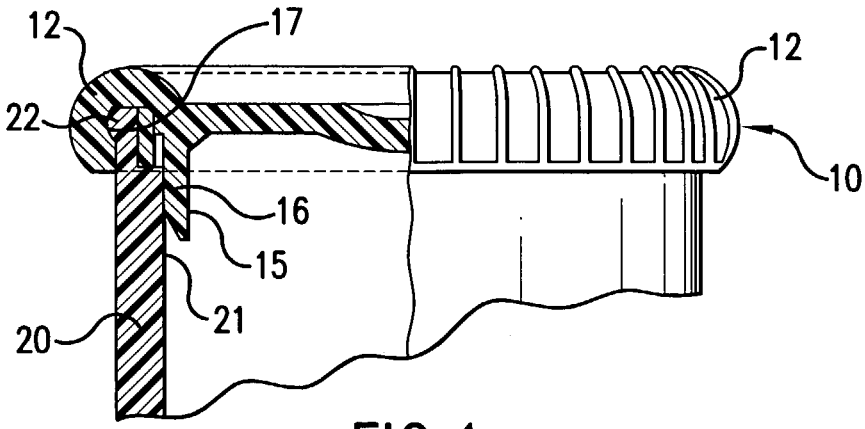
FIG. 1 is a partially cross-sectional and partially perspective view of a Quick-Twist Pop-Off Closure secured onto a container.

Referring now to the drawings, in which like numerals reflect like elements throughout the various views, FIG. 1 is a partially cross-sectional and partially perspective view of a Quick-Twist Pop-Off Closure 10 secured to a container 20 (see also FIGS. 4–8 for a better view of the container).

Figure 2:
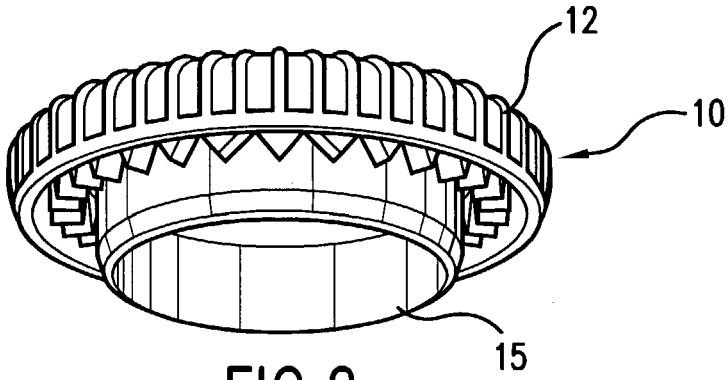
FIG. 2 is a bottom perspective view of the Quick-Twist Pop-Off Closure.
Figure 3:
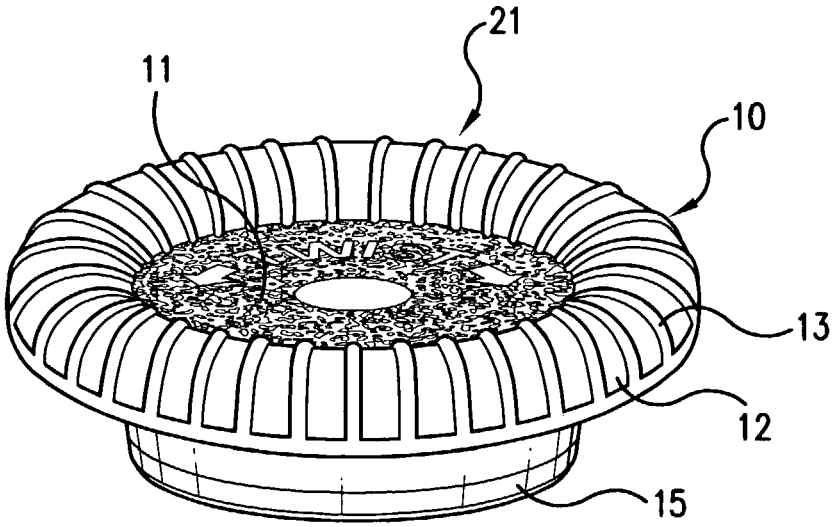
FIG. 3 is a top perspective view of the Quick-Twist Pop-Off Closure.
Figure 4:
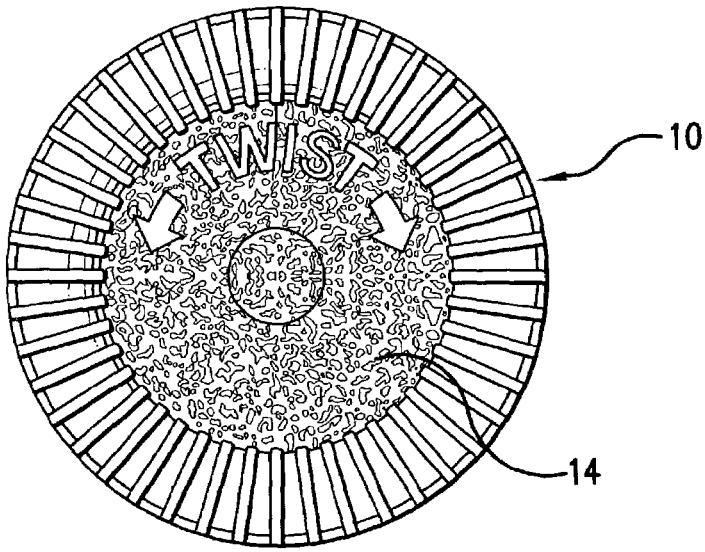
FIG. 4 is a plan view of the Quick-Twist Pop-off Closure.

The closure 20 has a top surface 11 (see FIG. 3) and a bottom side (see FIG. 2). The top surface 11 has an outer ring 12 which has a tactile gripping surface with raised ridges 13 to help a consumer facilitate the twisting of the closure in either direction as explained in greater detail herein.

The central portion 14 of the top 11 of the closure 10 may be textured or scuffed so that graphics or twist direction indication (see FIG. 4) or any other message or design may be easily imprinted by heat (describe) or molding.

The bottom side of the closure 10 generally comprises a plug seal 15 which is configured to sealingly fit into the container 20 as shown in FIG. 1 as the outer wall 16 of the plug seal abuts the inner wall 21 of the container 20. The bottom part of the plug seal is tapered as shown in FIG. 2. The bottom side also contains a row of teeth 18, which are configured as isosceles triangles and best seen in FIGS. 2 and 8.

Figure 6:
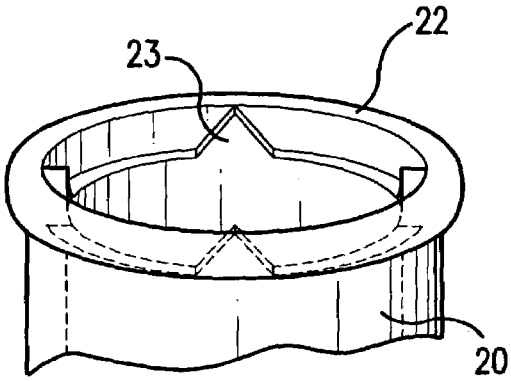
FIG. 6 is a front perspective view of a container showing ejector teeth therein.
Figure 7:
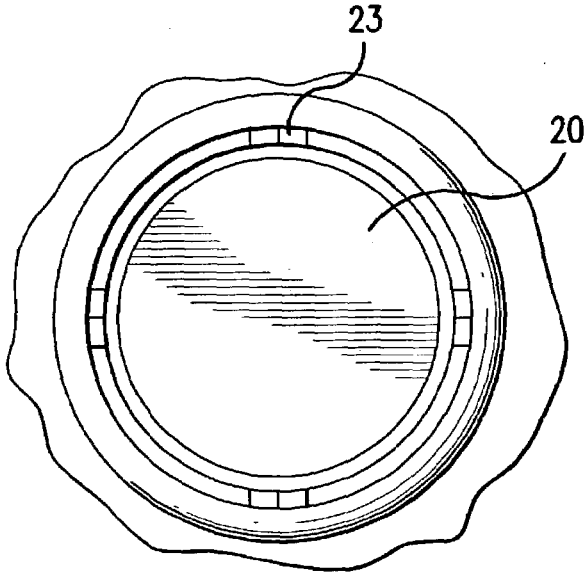
FIG. 7 is a plan view of a container shown in FIG. 6.
Figure 5:
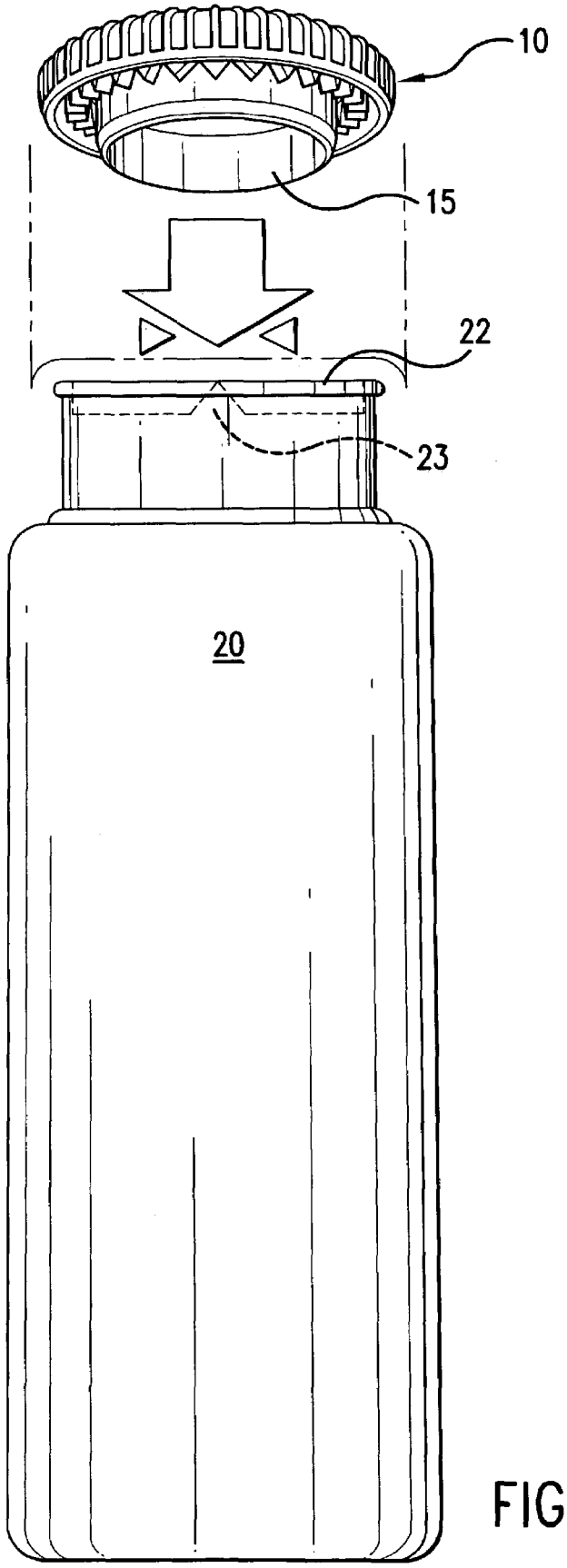
FIG. 5 is a front elevational view of the Quick-Twist Pop-Off Closure coming downward onto a container during assembly.

The container, which is typically injection blown, is best seen in FIGS. 6 and 7, preferably has four upwardly projecting teeth 23 which mate with corresponding teeth on the underside of the closure 10, as described further herein.

Securing of the closure is further facilitated by the underside 17 of the outer ring 12 surrounding and locking into position the upper lip 22 of the container 20. To secure the closure 10 onto the container 20, the plug seal 15 is brought downwardly into the container 20 so that the outer wall 16 of the plug seal abuts the inner wall 21 of the container 20 and is further secured by additional sufficient downward pressure on the closure 10 so that the underside 17 of the outer ring 12 of the closure 10 surrounds and locks into place the upper lip 22 of the container 20. The downward pressure also aligns the registration of the fourth ejector teeth 23 on the container 20 into the corresponding teeth 23 on the closure 10. Thus, the closure 10 is held secure by both the teeth registration and by the by the outer ring 12 surrounding and locking the outer lip 22 of the container 20.

Figure 8:
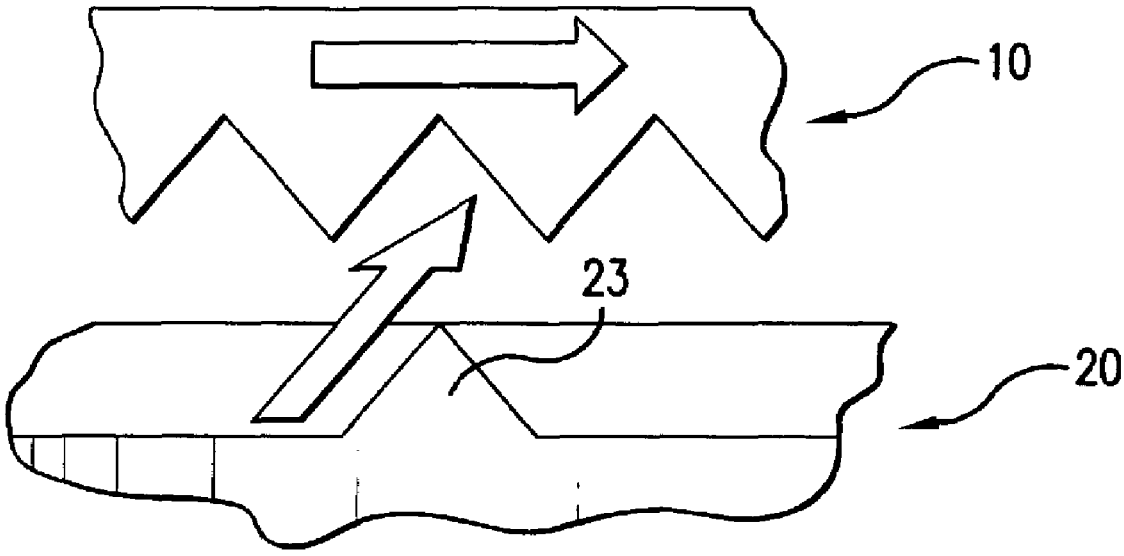
FIG. 8 is a schematic view of the teeth of the closure and container as they would interact during the closure opening/removal process.

To remove the closure 10, the top 11 may be twisted by the consumer in either direction. The twisting causes the lower teeth 23 to "ride down" the leg of the isosceles triangle as shown in FIG. 8, causing the closure 10 to move upwardly relative to the container 20. The upward pressure, in turn, causes the outer lip 22 of the container 20 to push downwardly on the underside 17 of the outer ring 12 causing it to spread or move outwardly until the closure 10 is released.

The closure 10 provides a lower manufacturing because of a simplified and faster assembly process. The assembly requires a straight downward force to engage the teeth and snap the closure 10 over the container's outer lip 22. The closure 10 does not require threading or turning to secure it onto the container and has thus simplified the assembly machinery and process along with reducing assembly time.

In the assembly process, to facilitate proper alignment of the closure 10 onto the container, a chuck or other mechanism which holds, for instance, the closure, may spin, vibrate or rotate the closure to prevent the unlikely occurrence of the point of the teeth of the closure and the container perfectly meeting to hinder the securing of the closure onto the container.

While the preferred embodiment of the invention has been depicted in detail, modifications and adaptations may be made thereto, without departing from the spirit and scope of the invention, as delineated in the following claims.

The invention claimed is:

1. An assembly of a cap and a container, comprising:

a container including:

a neck formed from a single piece of material and having an inner wall having first and second inner surfaces, the first and second inner surfaces defining different diameters of the neck, and an outer wall surface, at least one upwardly-extending tooth having camming surfaces formed by oppositely-sloped edges joined at a point of inflection and formed integrally on the inner wall adjacent to the first inner surface of the neck, and a cap including:

a top with an exterior surface and an interior surface, a side skirt extending downwardly from an outer periphery of the top and adapted to engage said outer wall of said container neck, a circumferential plug seal formed by a circumferential wall directly connected to the interior surface of the top, the seal forming a hollow cylinder extending downwardly from the top interior surface, the plug seal being sized and shaped to sealingly engage the second inner surface of the container neck, and a plurality of downwardly extending teeth spaced radially inward and apart from said side skirt and spaced radially outward and apart from the plug seal and directly connected to the top interior surface and circumferentially arranged near the periphery of the top and having camming surfaces formed by oppositely-sloped edges joined at a point of inflection and adapted to engage the camming surfaces of said at least one upwardly-extending tooth provided on said inner wall of said container neck, wherein said closure is sealingly attachable to said container by pressing downwardly on said exterior surface and is removable from said container by rotating said closure relative to the container in either the clockwise or counterclockwise directions to bring said downwardly extending tooth camming surfaces into operative engagement with said upwardly extending tooth camming surfaces to lift said closure from said container.

2. An assembly in accordance with claim 1, wherein said inner wall of said container neck further comprises a plurality of upwardly-extending teeth adapted to engage said plurality of downwardly-extending teeth provided on said cap.

3. An assembly in accordance with claim 1, further comprising gripping ridges provided on said side skirt.

4. An assembly in accordance with claim 1, further comprising gripping ridges provided on said exterior surface.

* * * * *